US005505165A

United States Patent [19]

Kimoto

[11] Patent Number: 5,505,165

[45] Date of Patent: Apr. 9, 1996

[54] COOLING CONTROL SYSTEM FOR AVOIDING VAPOR LOCK AFTER TURN OFF

[75] Inventor: Yasuhiro Kimoto, Himeji, Japan

[73] Assignee: Mitsubishi Denki Kabushiki Kaisha, Tokyo, Japan

[21] Appl. No.: 317,487

[22] Filed: Oct. 4, 1994

[30] Foreign Application Priority Data

Oct. 5, 1993 [JP] Japan ..... 5-249315

[51] Int. Cl.[6] ..... F01P 7/02

[52] U.S. Cl. ..... 123/41.12; 123/41.01; 123/41.31

[58] Field of Search ..... 123/41.01, 41.12, 123/41.48, 41.49, 41.31, 497, 516, 541

[56] References Cited

U.S. PATENT DOCUMENTS

| | | | |
|---|---|---|---|
| 4,098,236 | 7/1978 | Okawa | 123/541 |
| 4,168,456 | 9/1979 | Isobe | 123/41.12 |
| 4,327,674 | 5/1982 | Takei | 123/41.12 |
| 4,411,239 | 10/1983 | Kelch | 123/516 |
| 4,774,910 | 10/1988 | Aihara et al. | 123/41.12 |
| 5,144,916 | 9/1992 | Yoshida et al. | 123/41.12 |

FOREIGN PATENT DOCUMENTS

| | | | |
|---|---|---|---|
| 59-206651 | 11/1984 | Japan . | |
| 63-88261 | 4/1988 | Japan | 123/541 |

*Primary Examiner*—Noah P. Kamen
*Attorney, Agent, or Firm*—Sughrue, Mion, Zinn, Macpeak & Seas

[57] ABSTRACT

A controller for an automotive engine sets an activation time T when the key switch of the vehicle is turned on, and controls the radiator fan 8 and the fuel pump 10 for the set activation time after the key switch is turned off, such that the temperature rise of the fuel within the injectors and the generation of vapor therein at the restart of the engine is prevented. The activation time T is set at a predetermined positive value when the coolant water temperature is higher than a predetermined level, and at 0 otherwise (FIG. 2). Alternatively, the activation time T may be set at a value which depends on the sensed coolant water temperature (FIG. 3). Still alternatively, after the key switch is turned off, the radiator fan 8 and the fuel pump 10 may be controlled until the measured coolant water temperature falls below a predetermined level (FIG. 4).

8 Claims, 4 Drawing Sheets

COOLING CONTROL SYSTEM FOR AVOIDING VAPOR LOCK AFTER TURN OFF

BACKGROUND OF THE INVENTION

This invention relates to controllers for automotive engines, and more particularly to engine controllers with improved restarting performance.

In recent automotive engines, fuel injectors have replaced the carburetor. When fuel injectors are used as the fuel supply device of automotive engines, the amount of air intake into the engine is measured and an amount of fuel corresponding to the amount of air is injected from the fuel injectors. The amount of injected fuel can be adjusted in accordance with the operating condition of the engine. Thus, the fuel injectors are capable of performing strict control of the fuel supply necessary to satisfy the demand for the ever higher performance level of the engine, or to satisfy the strict regulations enforced against the polluting exhaust gas contents. To meet the demands for better performance, an increasing number of functions must now be provided by the engine controller. Thus, it is necessary that the engine controllers provide control not only of the injectors themselves, but also of the fuel pump for supplying the fuel to the injectors and of the radiator fan for cooling the engine.

To improve restarting performance, in particular, Japanese Patent Publication (Kokoku) No. 63-38537 proposes to augment the fuel pressure at the restart of the engine if the temperature of the engine is high. This Japanese patent publication controls the engine as follows.

First, it is judged whether or not the temperature of the engine is above a predetermined reference level at the restart of the engine. If the temperature of the engine is high, further judgment is made as to whether or not the time elapsed after the engine was stopped is within a predetermined length. If the judgement is affirmative (i.e., if the temperature of the engine is high and the time after the engine was stopped is within a predetermined length), the fuel pressure is increased to augment the amount of fuel and the idling RPM.

The control method proposed by the above Japanese Patent Publication improves the restarting performance. However, the method may be insufficient under certain conditions. For example, if the engine is stopped when the ambient temperature is high or after the vehicle has been driven for a long time at a high speed, the temperature of the engine remains high for a prolonged period. The temperature of the engine and of the parts associated therewith may even rise after the engine is stopped, since the engine is no longer cooled by the wind generated by the running vehicle. Thus, the temperature of the injectors and of the fuel within them may rise.

If the engine is restarted at the time when the injectors and the fuel within them are still at a high temperature, the vapor generated within the injectors hinders the supply of fuel. It thus becomes impossible to supply an appropriate amount of fuel corresponding to the amount of intake air. The augmentation of the amount of fuel becomes impossible. Since the necessary amount of fuel cannot be supplied, the proper air/fuel ratio cannot be maintained. The rotation of the engine thus becomes unstable, and the engine may even stall.

SUMMARY OF THE INVENTION

It is therefore an object of this invention to provide an automotive engine controller which, by cooling the engine after it is stopped, can effectively suppress the generation of vapor within the injectors, thereby effectively improving the restarting performance.

The above object is accomplished in accordance with the principle of this invention by a controller for an engine of an automotive vehicle, which includes: a key switch operation detector for detecting whether a key switch of the vehicle is turned on or off; a temperature sensor for detecting a parameter corresponding to a temperature of the engine; a temperature rise suppressor for suppressing a temperature rise of parts associated with the engine; an activation time setter, coupled to the key switch operation detector and the temperature sensor, for setting an activation time when the key switch operation detector detects that the key switch is turned on, wherein the activation time setter sets the activation time at a value greater than zero when the parameter corresponding to to the temperature of the engine detected by the temperature sensor is higher than a predetermined reference level; and a control unit, coupled to the key switch operation detector, for controlling the temperature rise suppressor, wherein, when the key switch operation detector detects that the key switch, which has been turned on, is turned off, the control unit controls the temperature rise suppressor for a length of time corresponding to the activation time set by the activation time setter. The activation time setter may set the activation time at a predetermined value greater than zero when the parameter corresponding to the temperature of the engine is higher than the predetermined reference level, the activation time setter setting the activation time equal to zero when the parameter corresponding to the temperature of the engine is below the predetermined reference level. Alternatively, the activation time setter may set the activation time at a value depending on a level of the parameter corresponding to the temperature of the engine detected by the temperature sensor, such that the value of the activation time is a function of the parameter.

According to an alternative aspect of this invention, the controller includes: a key switch operation detector for detecting whether a key switch of the vehicle is turned on or off; a temperature sensor for detecting a parameter corresponding to a temperature of the engine; a temperature rise suppressor for suppressing a temperature rise of parts associated with the engine; and a control unit, coupled to the key switch operation detector and the temperature sensor, for controlling the temperature rise suppressor, wherein, when the key switch operation detector detects that the key switch, which has been turned on, is turned off, the control unit controls the temperature rise suppressor until the parameter corresponding to the temperature of the engine falls below a predetermined temperature reference level.

Preferably, the parameter corresponding to the temperature of the engine is a temperature of a coolant water of the engine. The temperature rise suppressor may include a radiator fan for cooling the engine and the fuel pump for supplying fuel to the fuel injectors.

Still preferably, the controller comprises a central processing circuit including a microcomputer, and the activation time setter and the control unit are implemented by a program executed by the microcomputer. Then, it is preferred that the controller includes: a voltage source for supplying a source voltage to the central processing circuit; a switching circuit, operatively coupled to the key switch operation detector, for turning on the voltage source to supply the source voltage to the central processing circuit when the key switch operation detector detects that the key switch is turned on; and a holding circuit, coupled to the central processing circuit and the key switch operation detector, for holding the voltage source and keeping on supplying the source voltage to tile central processing circuit when the key switch operation detector detects that the key switch, which has been turned on, is turned off.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
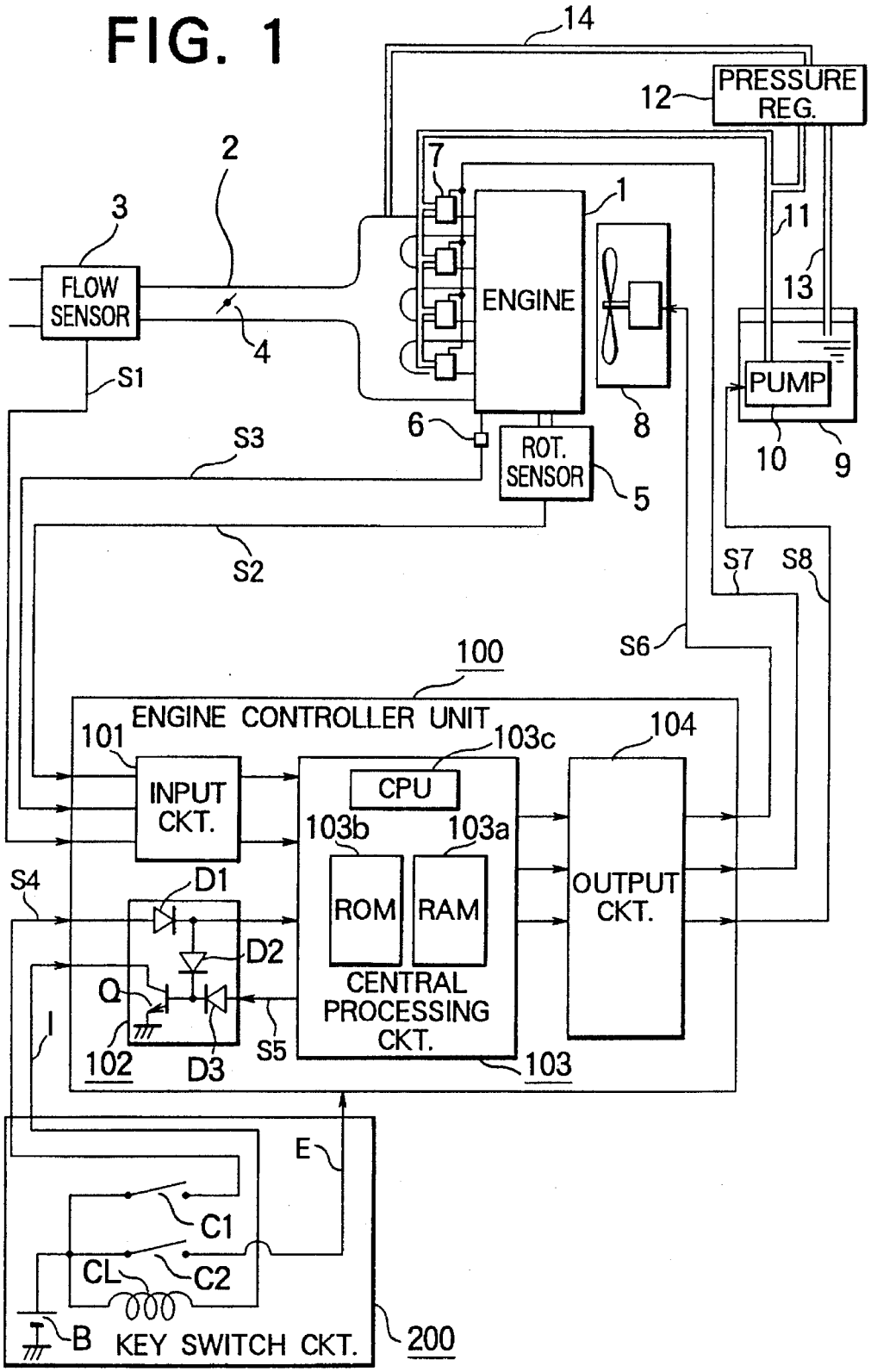
FIG. 1 is a block diagram showing the overall structure of an engine controller according to this invention.

FIG. 1 is a block diagram showing the overall structure of an engine controller according to this invention. The air is supplied to the engine 1 through an air intake pipe 2. An air flow sensor 3 detects the amount of air flow through the air intake pipe 2 and outputs an air flow detection signal S1 corresponding thereto. In response to the depression of the accelerator pedal of the vehicle by the driver, a throttle valve 4 mounted at the middle of the air intake pipe 2 regulates the amount of air intake.

A rotation sensor 5 detects the RPM of the engine 1 and outputs an RPM detection signal S2, on the basis of which the operating condition of the engine is determined. A water temperature sensor 6 detects the temperature of the coolant water within the jacket surrounding the cylinders of the engine, and outputs a water temperature detection signal S3. Fuel injectors 7 inject the fuel to the combustion chambers (not shown) within the respective cylinders. A radiator fan 8 generates an air flow past the radiator of the engine 1.

The fuel is stored in a fuel tank 9. A fuel pump 10 draws up the fuel from the fuel tank 9 and supplies it to the injectors 7 through a delivery pipe 11. The pressure of the fuel supplied to the injectors 7 through the delivery pipe 11 is regulated to a predetermined constant level by means of a fuel pressure regulator 12, which returns the surplus fuel drawn up by the fuel pump 10 to the fuel tank 9 through the return pipe 13. A negative pressure pipe 14 transmits the pressure within the air intake pipe 2 to the fuel pressure regulator 12, thereby providing information for the adjustment of the fuel pressure.

In response to a key operation signal S4 from a key switch circuit 200 as described below, an engine controller unit 100 outputs operation control signals S6, S7 and S8 to the injectors 7, the radiator fan 8 and the fuel pump 10, respectively. The engine controller unit 100 includes an input circuit 101, a self-holding circuit 102, a central processing circuit 103, and an output circuit 104. The input circuit 101 receives the air flow detection signal S1, RPM detection signal S2 and water temperature detection signal S3, and processes and converts these analog signals S1, S2 and S3 into corresponding digital signals. In response to the key operation signal S4 from the key switch circuit 200, the self-holding circuit 102 holds the source voltage E for the engine controller unit 100. The central processing circuit 103 includes a RAM **103*a*, a ROM 103*b* and a CPU 103*c* consisting of a microcomputer. The current values of the signals S1 through S4 are stored in the RAM 103*a*. In accordance with the control program stored in the ROM 103*b* and on the basis of the data stored in the RAM 103*a*, the CPU 103*c* generates the operation control signals S6, S7 and S8 for activating and controlling the injectors 7, the radiator fan 8 and the fuel pump 10, respectively. The details of the control operation of the engine controller unit 100 is described below by referring to FIGS. 2 through 4. The output circuit 104 outputs the operation control signals S6, S7 and S8 to the injectors 7, the radiator fan 8 and the fuel pump 10**, respectively.

The self-holding circuit 102 includes three diodes D1, D2 and D3, and a transistor Q. The key switch circuit 200 includes a battery B, a first contact C1, a second contact C2, and a relay coil CL. One of the two terminals of the first contact C1, the second contact C2 and the relay coil CL is each coupled to the positive terminal of the battery B. The negative terminal of the battery B is grounded. The diode D1, having an anode coupled to the terminal of the first contact C1 opposite to the battery B, is coupled at the cathode thereof to the central processing circuit 103. The diode D2, having an anode coupled to the cathode of the diode D1, is coupled at the cathode thereof to the base of the transistor Q. The transistor Q is coupled across the ground and the terminal of the relay coil CL opposite to the battery B, the collector and the emitter thereof being coupled to the relay coil CL and the ground, respectively. The diode D3 is coupled across the central processing circuit 103 and the base of the transistor Q, the forward conducting direction thereof being directed from the central processing circuit 103 to the transistor Q.

Upon operation of the key switch (not shown) by the driver of the vehicle, the first contact C1 is closed, to supply as the key operation signal S4 the positive voltage of the battery B through the diode D1 to the central processing circuit 103. At the same time, the key operation signal S4 is supplied through the diode D2, to the base of the transistor Q. Upon generation of the key operation signal S4, the transistor Q is thus turned on, and the excitation current I flows from the battery B through the relay coil CL. Upon excitation of the relay coil CL, the second contact C2 is closed, to supply the source voltage E of the battery B to the engine controller unit 100. Further, as described in detail below, when the key switch is turned off to open the first contact C1 and the key operation signal S4 ceases, the central processing circuit 103 outputs a source hold signal S5 through the diode D3 to the base of the transistor Q, such that the transistor Q is again turned on, to supply the excitation current I through the relay coil CL. The second contact C2 is closed again, to supply the source voltage E to the engine controller unit 100.

Figure 2:
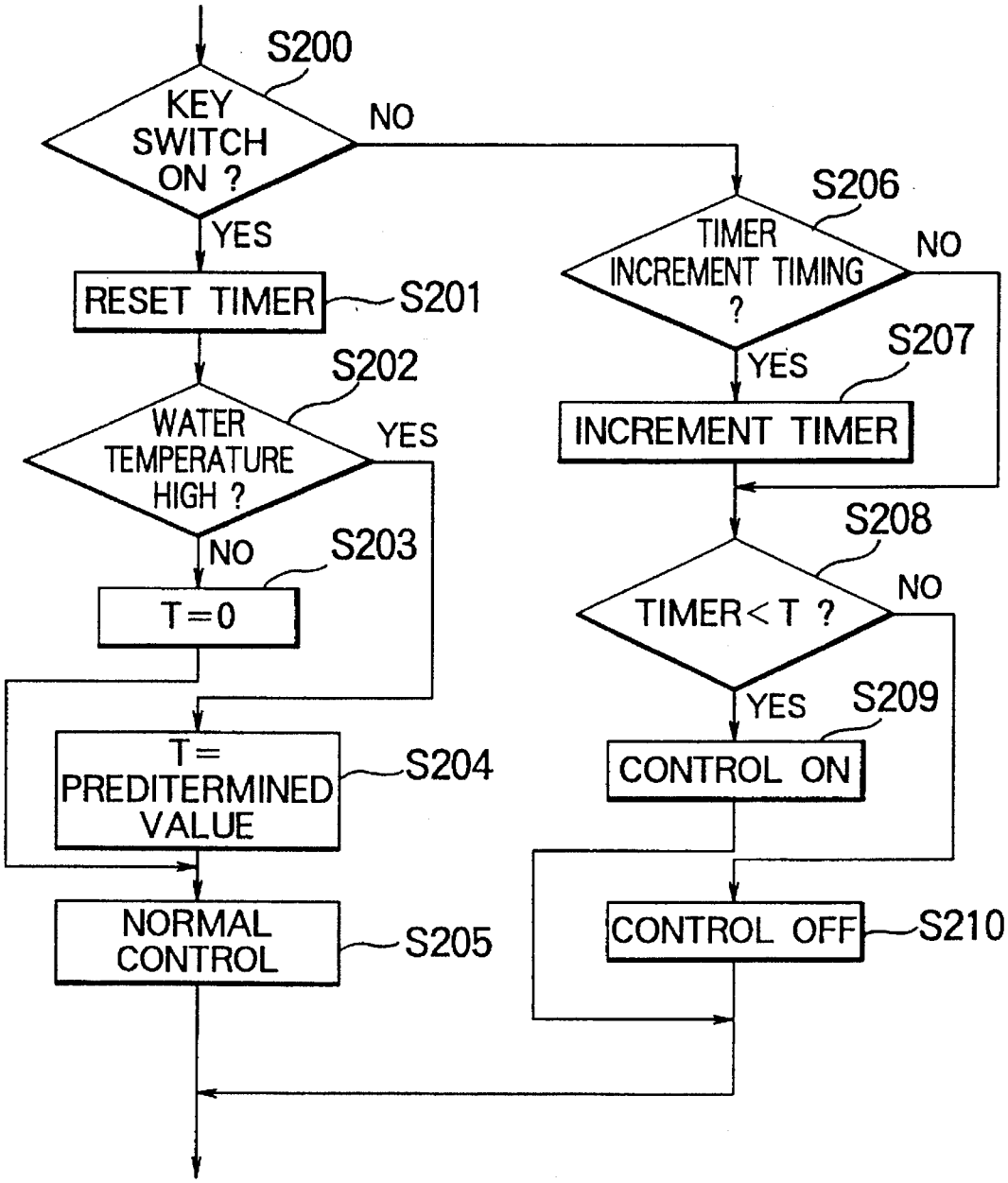
FIG. 2 is a flowchart showing the control procedure followed by the engine controller unit according to this invention, by which the radiator fan and the fuel pump are operated for a predetermined interval of time after the engine is stopped.

FIG. 2 is a flowchart showing the control procedure followed by the engine controller unit according to this invention, by which the radiator fan and the fuel pump are operated for a predetermined interval of time after tile engine is stopped. The procedure of FIG. 2 is executed by the CPU 103*c* of the central processing circuit 103 in accordance with the program stored in the ROM 103*b* and on the basis of the data stored in the RAM 103*a*.

At step S200, the central processing circuit 103 judges whether or not the key switch is turned on. The judgment is performed as follows.

The key switch generally includes the OFF, ON and START positions. Upon starting the engine, the driver of the vehicle turns the key switch from the OFF through the ON to the START position to activate the starter motor and start the engine. After the engine is started, the key switch is returned to the ON position. When the key switch is either at the ON or the START position, the electrical system of the vehicle is turned on and the first contact C1 of the key switch circuit 200 is closed. Thus, the positive voltage from the battery B is supplied through the diode D1 to the central processing circuit 103 as the key operation signal S4, and, further through the diode D2, to the base of the transistor Q. Upon receiving the key operation signal S4 on the base, the transistor Q is turned on, and the excitation current I supplied from the battery B flows through the relay coil CL to the ground. Upon excitation of the relay coil CL, the second contact. C2 is turned on, to supply the source voltage E of of the battery B to the engine controller unit 100.

Upon receiving the source voltage E, the central processing circuit 103 reads in the key operation signal S4 supplied through the diode D1. If the key operation signal S4 is at the high level, the central processing circuit 103 judges that the key switch is turned on (i.e., either at the ON or START position). If, on the other hand, the key operation signal S4 is at the low level, the central processing circuit 103 judges that the key switch is turned off (i.e., at the OFF position and hence the electrical system of the vehicle is turned off).

If the judgement is affirmative at step S200 (i.e., if the key switch is turned on), the execution proceeds to the steps S201 through S205, where the activation time T (which represents the length of time during which the radiator fan 8 and fuel pump 10 is activated after the engine is stopped) is set and the TIMER variable (which is to measure the time that elapses after the engine is stopped) is reset. On the other hand, if the judgement is negative at step S200 (i.e., if the key switch is turned off), the execution proceeds to steps S206 through S210, where the engine controller unit 100 keeps on controlling the radiator fan 8 and the fuel pump 10 for an interval of time represented by the activation time T after the engine is stopped. First, the steps S201 through S205 are described in detail.

At step S201, the TIMER variable is reset to 0. Namely, the TIMER variable is assigned the value 0. The TIMER variable may be stored at a predetermined address of the RAM 103*a*.

Next, at step S202, it is judged whether or not the water temperature is high. Namely, the central processing circuit 103 reads in the water temperature detection signal S3 from the water temperature sensor 6, and judges whether or not the coolant water temperature is high (i.e., above a predetermined reference level). If the judgement is affirmative at step S202 (i.e., if the coolant water temperature is above the reference), the execution proceeds to step S204, where the activation time T, a variable stored at a predetermined address in the RAM 103*a*, is assigned a predetermined positive value greater than 0.

On the other hand, if the judgement is negative at step S202 (i.e., if the coolant water temperature is below the reference), the execution proceeds to step S203, where the activation time T is assigned the value 0.

Further, at step S205, the central processing circuit 103 performs the normal control operation of the injectors 7, the radiator fan 8 and the fuel pump 10. Namely, in accordance with the operating state of the engine 1 as determined, for example, from the RPM of the engine 1 received from the rotation sensor 5 through the input circuit 101, the central processing circuit 103 calculates the respective operation control signals S6, S7 and S8 for the injectors 7, the radiator fan 8 and the fuel pump 10, respectively and outputs them.

The steps S200 through S205 are repeated at a predetermined execution period until the key switch is turned off and the judgment at step S200 becomes negative. Thus, if the temperature of the coolant water temperature rises above the predetermined reference level during the execution cycles of the steps S200 through S205, the judgment at step S202 then becomes affirmative, and, at step S204, the activation time T is assigned a predetermined positive value.

When the key switch is eventually turned off, the judgment at step S200 becomes negative and the steps S206 through S210 are executed.

Namely, when the key switch is turned off to open the first contact C1 of the key switch circuit 200, the transistor Q is turned off to interrupt the supply of the excitation current I to the relay coil CL. The second contact C2 is thus opened to interrupt the application of the source voltage E to the engine controller unit 100. However, when the central processing circuit 103 detects that the key operation signal S4 has ceased (and hence that the key switch is turned off), it outputs the source hold signal S5 to the base of the transistor Q through the diode D3. As a result, the transistor Q is turned on to supply the excitation current I from the battery B to the relay coil CL. The second contact C2 is thus again turned on (i.e., closed), to hold the source voltage E supplied to the engine controller unit 100.

The step S200 and the steps S206 through S210 are executed periodically after the engine is stopped. Thus, if the temperature of the engine is high and the activation time T is assigned a predetermined positive value at step S204, the engine controller unit 100 keeps on controlling the radiator fan 8 and the fuel pump 10 until a predetermined interval of time as represented by the activation time T expires, such that the rise of the temperature of the fuel within the injectors 7 and hence the generation of vapor within the injectors 7 at the restart of the engine is prevented. Next these steps S206 through S210 are described in detail.

At steps S206 and S207, the TIMER variable (reset at step S201) is incremented at a fixed period. Namely, at step S206, it is judged whether or not the present instant is at a TIMER increment timing. TIMER increment timings occur at a predetermined fixed period, i.e., at each fixed number of clocks of the central processing circuit 103. If the judgement is affirmative at step S206 (i.e., if it is at a TIMER increment timing), the execution proceeds to step S207 where the TIMER is incremented. Otherwise, the execution proceeds directly to step S208. Thus, in each execution cycle of the steps S206 through S210, the value of the TIMER variable, updated at steps S206 and S207, represents the length of time that has elapsed after the key switch is turned off.

At step S208, it is judged whether the time elapsed after the key switch is turned off is less than the activation time T set at step S203 or step S204. Namely, it is judged whether or not the TIMER variable is less than activation time T. If the judgement is affirmative at step S208, the execution proceeds to step S209, where the engine controller unit 100 continues to control and activate the radiator fan 8 and the fuel pump 10. If the judgement is negative at step S208 (and hence a time longer than or at least equal to the activation time T has elapsed after the key switch is turned off), the execution proceeds to step S210, where the central processing circuit 103 stops controlling the radiator fan 8 and the fuel pump 10. It is noted that if the coolant water temperature is low when the engine is stopped and hence the activation time T is assigned the value 0 at step S203, the radiator fan 8 and the fuel pump 10 are stopped immediately after the engine is stopped. On the other hand, if the coolant water temperature is high when the engine is stopped, the engine controller unit 100 keeps on controlling the radiator fan 8 and the fuel pump 10 for the activation time T, to cool the engine and to prevent the temperature rise of the fuel and the generation of vapor within the injectors 7. After a predetermined length of time longer than the value assigned to the activation time T, the central processing circuit 103 may return the source hold signal S5 to the low level, to turn off the transistor Q and stop the supply of excitation current I from the battery B to the relay coil CL.

In the case of the above embodiment, the activation time T is assigned a predetermined fixed value. The activation time T, however, may be assigned a value dependent on the coolant water temperature.

Figure 3:
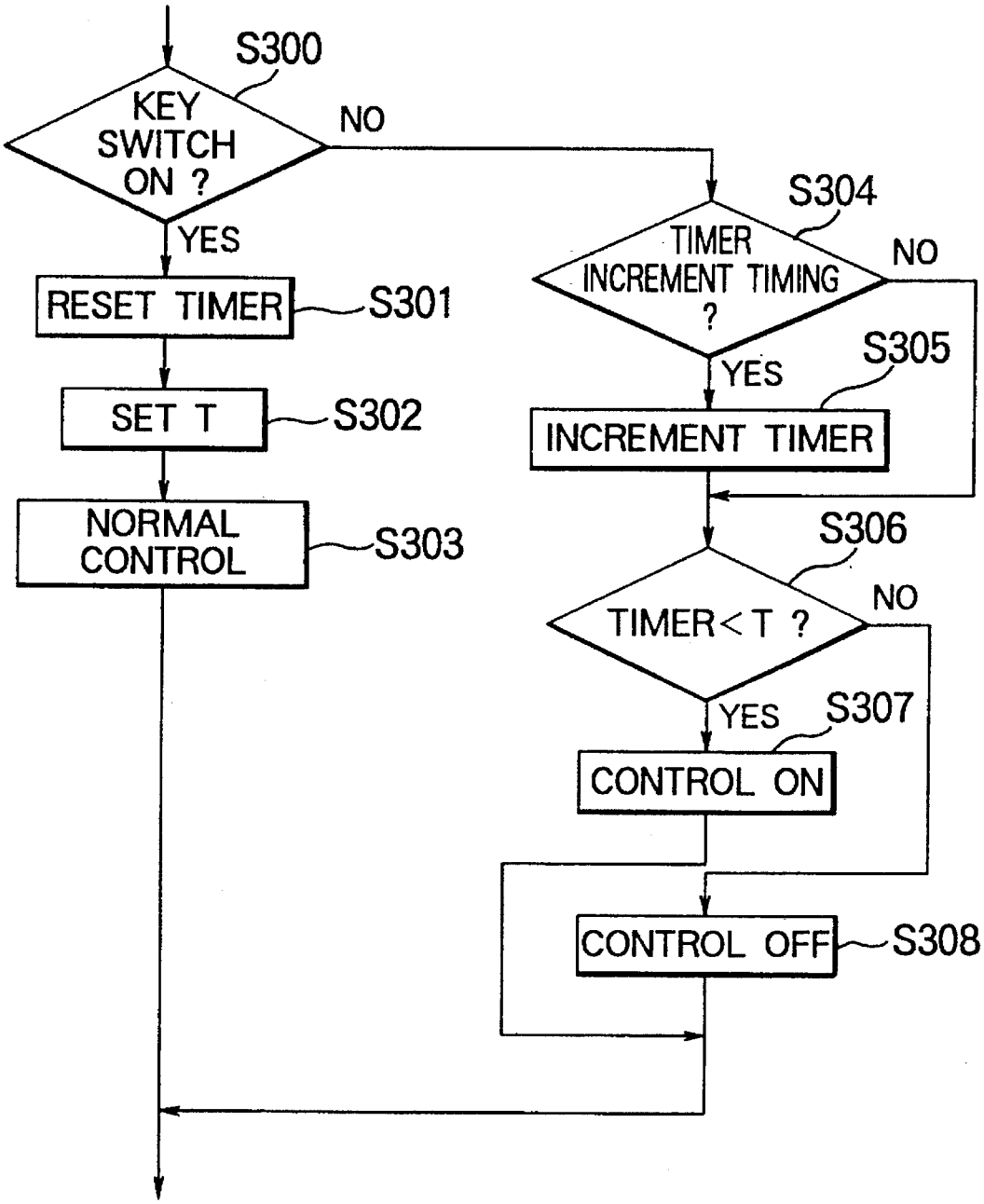
FIG. 3 is a flowchart similar to that of FIG. 2, but showing another procedure according to this invention, by which, after the engine is stopped, the radiator fan and the fuel pump are operated for an interval of time corresponding to the coolant water temperature that is detected at the time when the key switch is turned off.

FIG. 3 is a flowchart similar to that of FIG. 2, but showing another procedure according to this invention, by which, after the engine is stopped, the radiator fan and the fuel pump are operated for an interval of time corresponding to the coolant water temperature that is detected at the time when the key switch is turned off. Thus, at step S302, corresponding to the steps S202 through S204, the activation time T is assigned a value corresponding to the coolant water temperature. Namely, the central processing circuit 103 reads in the water temperature detection signal S3 from the water temperature sensor 6, and calculates a value of the activation time T corresponding to the coolant water temperature. The value is then assigned to the activation time T. The value of the activation time T increases as the coolant water temperature rises. The relation between the activation time T and the coolant water temperature may be determined experimentally.

Other than the step S302, the procedure of FIG. 3 is similar to that of FIG. 2. The steps S300, S301 and S303 of FIG. 3 correspond to the the steps S200, S201 and S205 of FIG. 2. The steps S304 through S308 of FIG. 3 correspond to the steps S204 through S208 of FIG. 2, respectively.

According to the procedure of FIG. 3, after the key switch is turned off and the engine is stopped, the radiator fan 8 and the fuel pump 10 are operated for an interval corresponding to the temperature of the coolant water temperature that is measured at the time when the key switch is turned off. The activation time T is thus a function of coolant water temperature at the time of stopping the engine, and the radiator fan 8 and the fuel pump 10 are operated longer as the coolant water temperature is higher. It is thus ensured that the engine is cooled before it is restarted.

In accordance with the procedures of FIGS. 2 and 3, the radiator fan 8 and the fuel pump 10 are operated for the activation time T, whether it be fixed or variable. According to these procedures, the activation time T is set before the engine stops and the radiator fan 8 and the fuel pump 10 are controlled for the activation time T after the engine stops. However, the actual coolant water temperature may be measured periodically after the engine stops, such that the radiator fan 8 and the fuel pump 10 are controlled until the measured coolant water temperature falls below a predetermined level.

Figure 4:
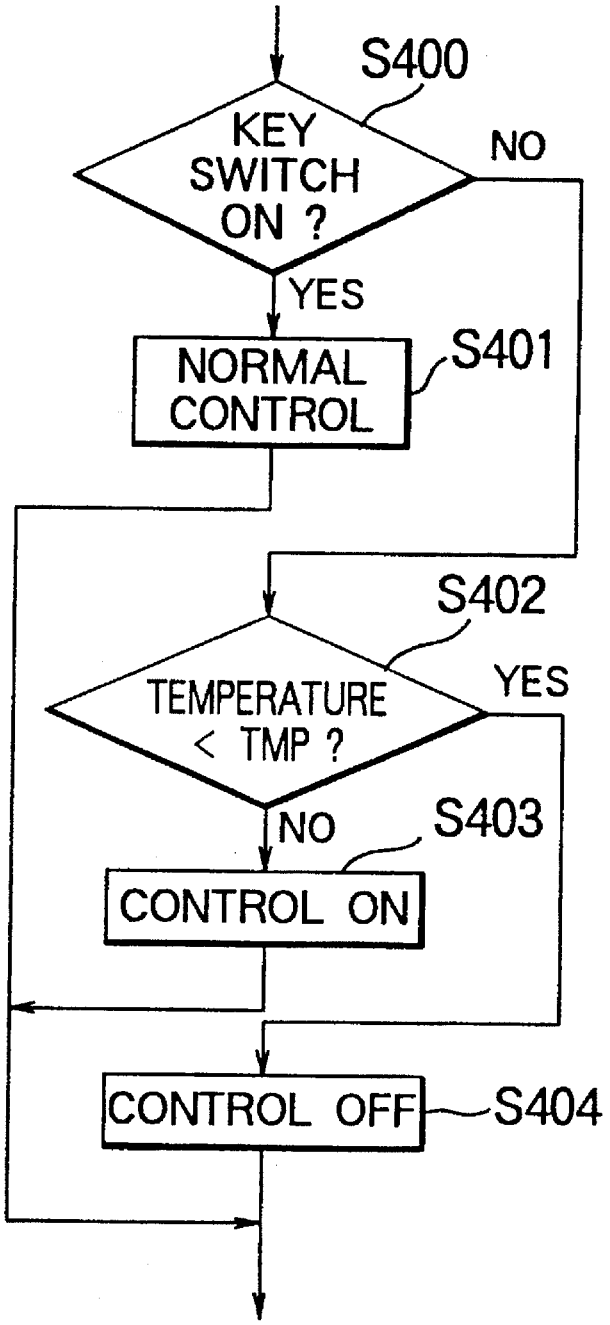
FIG. 4 is a flowchart similar to that of FIGS. 2 and 3, but showing still another procedure according to this invention, by which, after the engine is stopped, the radiator fan and the fuel pump are operated until the coolant water temperature falls below a predetermined level.

FIG. 4 is a flowchart similar to that of FIGS. 2 and 3, but showing still another procedure according to this invention, by which, after the engine is stopped, the radiator fan and the fuel pump are operated until the coolant water temperature falls below a predetermined level.

At step S400, it is judged whether or not the key switch is turned on. The step S400 corresponds to step S200 of FIG. 2, and is executed at a predetermined execution period. If the judgement is affirmative at step S400, the execution proceeds to step S401, where the normal control is performed. The step S401 corresponds to step S205 of FIG. 2. So long as the key switch is turned on, the step S400 and the step S401 are executed periodically.

When, on the other hand, the key switch is turned off and the judgment at step S400 finally becomes negative, the steps S402 through S404 are performed periodically, such that the radiator fan 8 and the fuel pump 10 are operated until the coolant water temperature falls below a predetermined level.

Namely, at step S402, the CPU 103*c* of the central processing circuit 103 reads in the water temperature detection signal S3 from the water temperature sensor 6 and stores the measured temperature in a TEMPERATURE variable in the RAM 103*a*. Further, the CPU 103*c* judges whether or not the TEMPERATURE variable is less than a reference temperature TMP. If the judgement is negative at step S402 (i.e., if the current coolant water temperature as represented by TEMPERATURE variable is greater than or at least equal to the reference temperature TMP), the execution proceeds to step S403, where the central processing circuit 103 controls the radiator fan 8 and the fuel pump 10. On the other hand, if the judgement is affirmative at step S402, the execution proceeds to step S404, where the central processing circuit 103 stops controlling the radiator fan 8 and the fuel pump 10. The steps S403 and S404 correspond to steps S209 and S210 of FIG. 2, respectively.

According to the procedure of FIG. 4, it is ensured that the temperature of the engine is cooled at least to the reference temperature TMP after the engine is stopped, irrespective of the environment condition. Even if the ambient temperature is high, the engine is thus cooled before the engine is restarted and the generation of vapor in the injectors 7 is prevented.

In the case of the procedures of FIGS. 2 and 3, the activation time T is set on the basis of the coolant water temperature. In the case of the procedure of FIG. 4, the radiator fan 8 and the fuel pump 10 are controlled until the coolant water temperature is below a predetermined reference. Thus, according to these procedures, the coolant water temperature is the parameter for determining whether or not the radiator fan 8 and the fuel pump 10 are operated after the engine is stopped or for determining the length of time during which the radiator fan 8 and the fuel pump 10 are operated. Other parameters, such as the temperature of the intake air, however, may be used in stead of the coolant water temperature, for determining whether or not the radiator fan 8 and the fuel pump 10 are operated after the engine is stopped or for determining the length of time during which the radiator fan 8 and the fuel pump 10 are operated.

What is claimed is:

1. A controller for an engine of an automotive vehicle including fuel injectors supplied with fuel drawn from a fuel tank by a fuel pump, said controller comprising:

a) key switch operation detector means for detecting whether a key switch of said vehicle is turned on or off;

b) temperature sensor means for detecting a coolant water temperature of said engine;

c) cooling means including a radiator fan (8) and said fuel pump (10) for cooling said engine and fuel injectors, respectively; and means for minimizing the evaporation of residual fuel within the injectors following engine turn off, and the attendant creation of re-start inhibiting vapor lock, said minimizing means comprising:

d) activation time setting means, coupled to said key switch operation detector means and said temperature sensor means, for setting an activation time at a value greater than zero when:

1) said key switch operation detector means detects that said key switch is turned on, and 2) said detected coolant water temperature is higher than a predetermined reference level; and e) control means, coupled to said key switch operation detector means, for energizing said cooling means for a length of time corresponding to said set activation time when said key switch operation detector means detects that said key switch has been turned off.

2. A controller as claimed in claim 1, wherein said activation time setting means sets said activation time at zero when said detected coolant water temperature is lower than said predetermined reference level.

3. A controller as claimed in claim 1, wherein said activation time setting means sets said activation time at a value corresponding to a level of said detected coolant water temperature, such that said activation time value is a function of said parameter.

4. A controller as claimed in claim 1, wherein said controller comprises a central processing circuit including a microcomputer, and said activation time setting means and said control means are implemented by a program executed by said microcomputer.

5. A controller as claimed in claim 4, further comprising:

a) a voltage source (B) for supplying a source voltage to said central processing circuit (103);

b) switching circuit means (200), operatively coupled to said key switch operation detector means, for turning on said voltage source to supply said source voltage to said central processing circuit when said key switch operation detector means detects that said key switch is turned on; and c) holding circuit means (102), coupled to said central processing circuit and said key switch operation detector means, for holding said voltage source and keeping on supplying said source voltage to said central processing circuit when said key switch operation detector means detects that said key switch has been turned off.

6. A controller for an engine of an automotive vehicle including fuel injectors supplied with fuel drawn from a fuel tank by a fuel pump, said controller comprising:

a) key switch operation detector means for detecting whether a key switch of said vehicle is turned on or off;

b) temperature sensor means for detecting a coolant water temperature of said engine;

c) cooling means including a radiator fan (8) and said fuel pump (10) for cooling said engine and fuel injectors, respectively; and means for minimizing the evaporation of residual fuel within the injectors following engine turn off, and the attendant creation of re-start inhibiting vapor lock, said minimizing means comprising:

d) control means, coupled to said key switch operation detector means and said temperature sensor means, for energizing said cooling means when said key switch operation detector means detects that said key switch has been turned off until said detected coolant water temperature falls below a predetermined temperature reference level.

7. A controller as claimed in claim 6, wherein said controller comprises a central processing circuit including a microcomputer, and said activation time setting means and said control means are implemented by a program executed by said microcomputer.

8. A controller as claimed in claim 7, further comprising:

a) a voltage source (B) for supplying a source voltage to said central processing circuit (103);

b) switching circuit means (200), operatively coupled to said key switch operation detector means, for turning on said voltage source to supply said source voltage to said central processing circuit when said key switch operation detector means detects that said key switch is turned on; and c) holding circuit means (102), coupled to said central processing circuit and said key switch operation detector means, for holding said voltage source and keeping on supplying said source voltage to said central processing circuit when said key switch operation detector means detects that said key switch has been turned off.

* * * * *